United States Patent [19]

Fiorese

[11] Patent Number: 4,982,595

[45] Date of Patent: Jan. 8, 1991

[54] APPARATUS FOR REPAIRING DAMAGED VEHICLES

[76] Inventor: Francesco Fiorese, Via S. Andrea 50, 35020 Albignasego (Province of Padova), Italy

[21] Appl. No.: 440,561

[22] Filed: Nov. 20, 1989

[30] Foreign Application Priority Data

Nov. 18, 1988 [IT] Italy ..... 41713 A/88

[51] Int. Cl.[5] ..... B21D 1/12

[52] U.S. Cl. ..... 72/447; 72/705; 187/8.43

[58] Field of Search ..... 72/447, 457, 705; 187/8.41, 8.43

[56] References Cited

U.S. PATENT DOCUMENTS

| | | | |
|---|---|---|---|
| 4,463,937 | 8/1984 | Celette | 72/705 |
| 4,542,636 | 9/1985 | Wright | 72/705 |
| 4,574,614 | 3/1986 | Field | 72/705 |
| 4,658,627 | 4/1987 | Brewer, Sr. | 72/705 |
| 4,660,405 | 4/1987 | Widegren et al. | 72/705 |
| 4,724,930 | 2/1988 | VanLierop | 187/8.43 |
| 4,823,589 | 4/1989 | Maxwell, Jr. et al. | 72/705 |

*Primary Examiner*—Lowell A. Larson

*Attorney, Agent, or Firm*—Guido Modiano; Albert Josif

[57] ABSTRACT

The apparatus comprises a quadrangular frame on which a vehicle to be repaired can be fixed by means of appropriate templates. The frame is rigidly associated with a pantograph mechanism capable of raising and lowering it to the required distance from the ground. Longitudinal guide elements for at least one movable carriage are fixed to the frame, and a support for a device for tensioning the damaged bodywork is pivoted to the carriage and can rotate on a substantially horizontal plate. At least one pair of wheeled vehicle-holder crosspieces are slidable on the frame and are associated with adjustable-height wheeled elements. Each crosspiece has two jacks for lifting and positioning a vehicle on the templates.

16 Claims, 4 Drawing Sheets

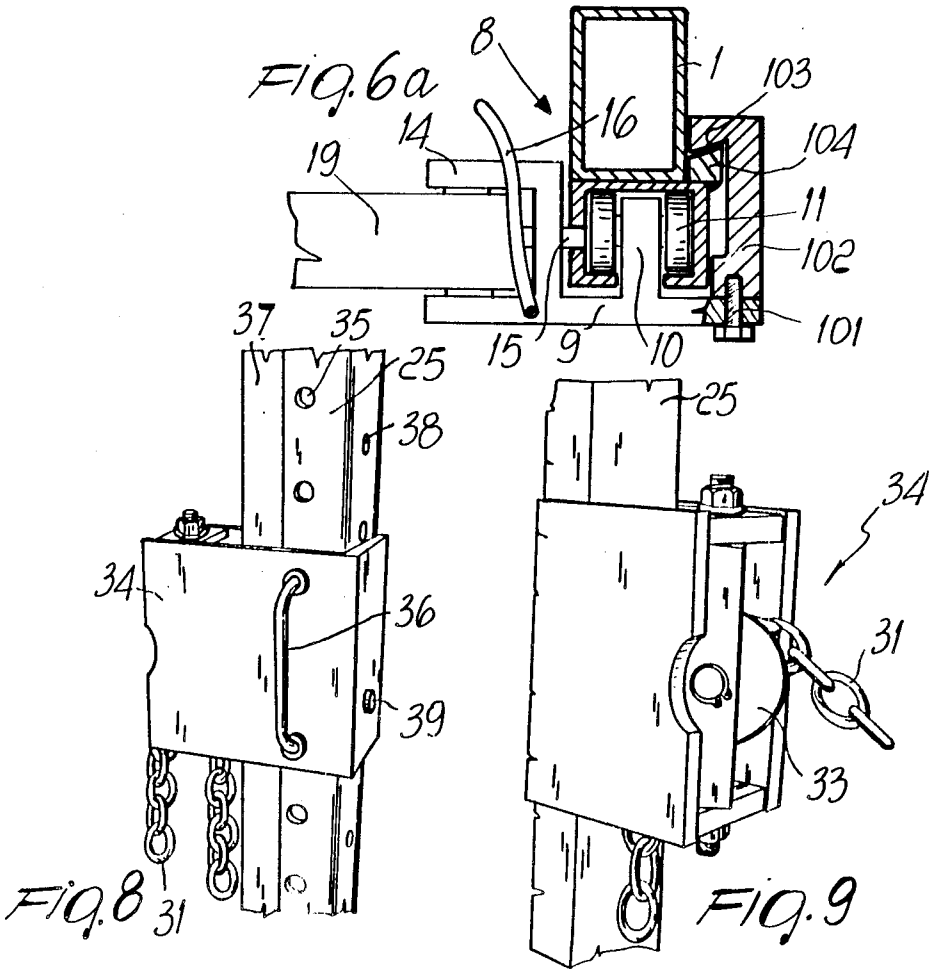
FIG. 6a
FIG. 9
FIG. 8
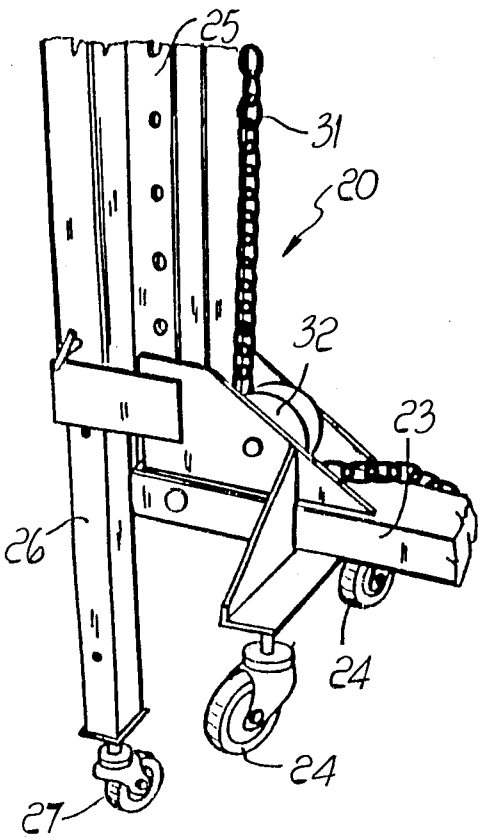
FIG. 7

APPARATUS FOR REPAIRING DAMAGED VEHICLES

BACKGROUND OF THE INVENTION

The present invention relates to an apparatus for repairing damaged vehicles, particularly but not exclusively suitable for use in vehicle repair workshops.

Apparata are currently used to repair damaged vehicles which are substantially constituted by a rectangular base frame with holes for fixing templates on which the vehicle is placed and, by a substantially L-shaped traction element, comprising a lower strut which can be fixed to the frame and an upper traction arm articulated to the strut.

The traction arm is actuated by a piston, and the end of a traction element, constituted by a chain or other flexible element, is fixed thereto.

In order to allow the operator to work in comfort even when working on the lower part of the vehicle, the frame is equipped with mechanisms adapted to raise it from the ground.

The lifting mechanisms currently in use are mainly constituted by three types; a first type of lifting mechanism is substantially constituted by four columns arranged at the corners of the frame; said frame is rigidly associated with said columns and can slide only in a vertical direction.

A second type of lifting mechanism comprises a central lifting piston which co-operates with appropriate structure reinforcement supports.

A third type of lifting mechanism is constituted by a central scissor-like element which however only allows a limited elevation from the ground.

Various systems comprising platforms, ramps, trolleys and stands are currently used to load the vehicles onto the frame and to fix them to the templates.

Although widely used, the above described apparata are not free from disadvantages, including a certain slowness in operation, resulting from the use of the above mentioned traction elements, which cannot be rapidly attached to and removed from the frame.

Other disadvantages arise from the lifting mechanisms, and in particular from the considerable bulk of the column type mechanisms, combined with the operational impediment constituted by said columns for whoever needs to operate around the vehicle with no hindrance of any sort.

The central-piston type mechanism does not offer adequate assurances of rigidity during work and requires the provision of a pit defining a depth which is greater than the elevation to be obtained for the frame.

The scissor-like mechanisms currently in use furthermore do not allow the operator to work on the lower part of the vehicle without extreme discomfort.

The loading devices are finally complicated and slow to use.

SUMMARY OF THE INVENTION

The aim of the present invention is to provide an apparatus for repairing damaged vehicles which solves the disadvantages described above in the known art.

Within this aim, a primary object of the invention is to provide an apparatus which renders the operations for repairing damaged vehicles faster, easier and more convenient.

Another important object of the invention is to provide an apparatus which can be manifactured from readily available elements.

Another object of the invention is to reduce the labor costs required for repairing damaged vehicles.

A not least object of the invention is to provide a low-cost apparatus.

This aim, these objects and others which will become apparent hereinafter are achieved by an apparatus for repairing damaged vehicles, comprising a quadrangular frame on which a vechile to be repaired can be fixed by means of appropriate templates, said frame being rigidly associated with a pantograph mechanism adapted to raise it and lower it, characterized in that longitudinal guiding and fixing elements for at least one carriage are rigidly associated with said frame, a support for means for subjecting the damaged bodywork to traction being articulated to said carriage on a substantially horizontal plane, at least one pair of wheeled vehicle-holder crosspieces being slidable on said frame and associated with adjustable-height wheeled elements for sliding on the ground, each crosspiece having means for lifting and positioning the vehicle on said templates.

BRIEF DESCRIPTION OF THE DRAWINGS

Further characteristics and advantages of the invention will become apparent from the detailed description of an embodiment, illustrated only by way of non-limitative example in the accompanying drawings, wherein.

Figures 1, 2, 3:
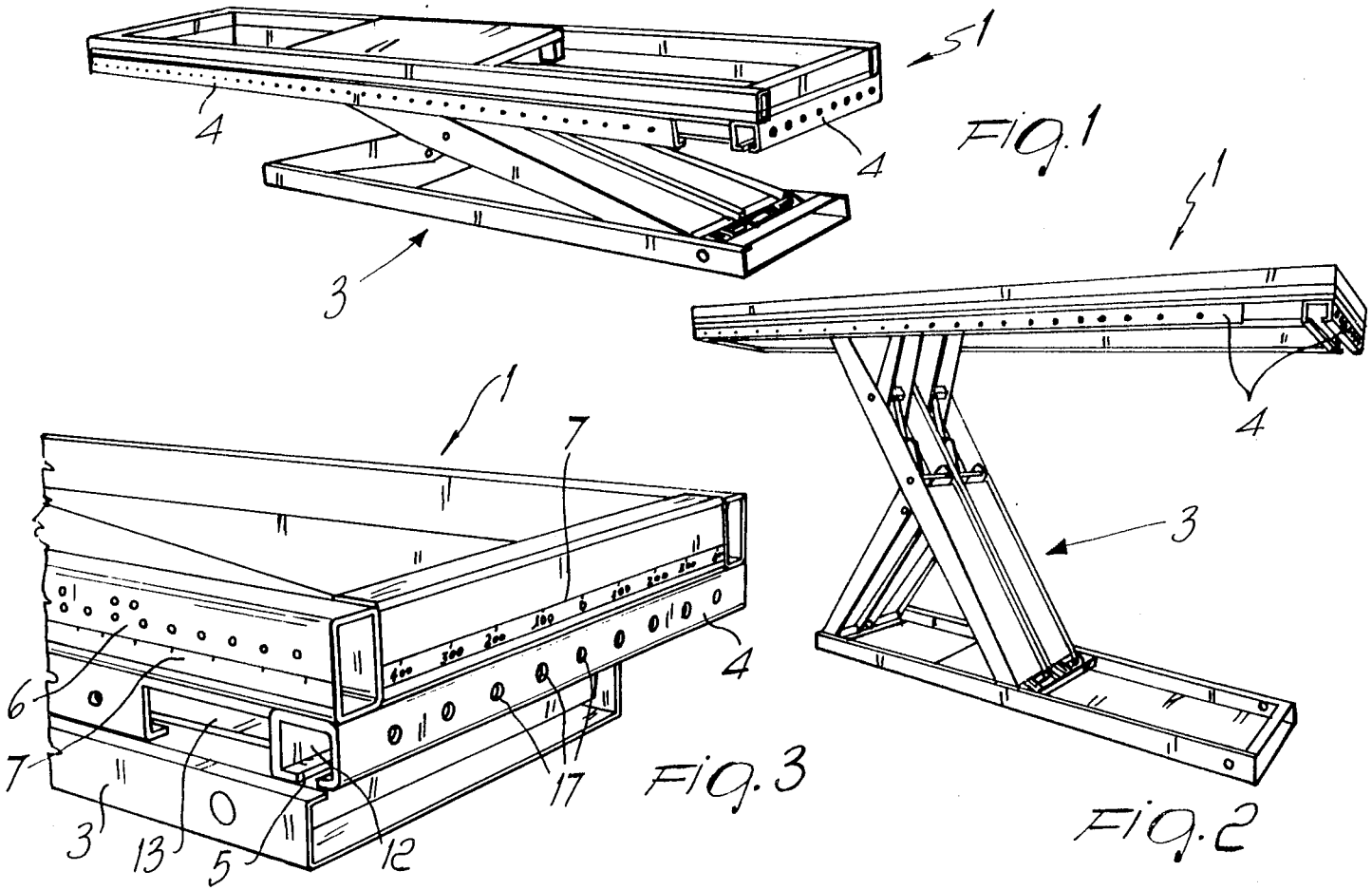
FIG. 1 is a perspective view of the frame of the apparatus according to the invention, slightly raised from the ground.
FIG. 2 is a perspective view of the frame of FIG. 1 in the position of maximum elevation from the ground.
FIG. 3 is an enlarged detail view of the frame of FIGS. 1 and 2.
Figures 4, 5, 6:
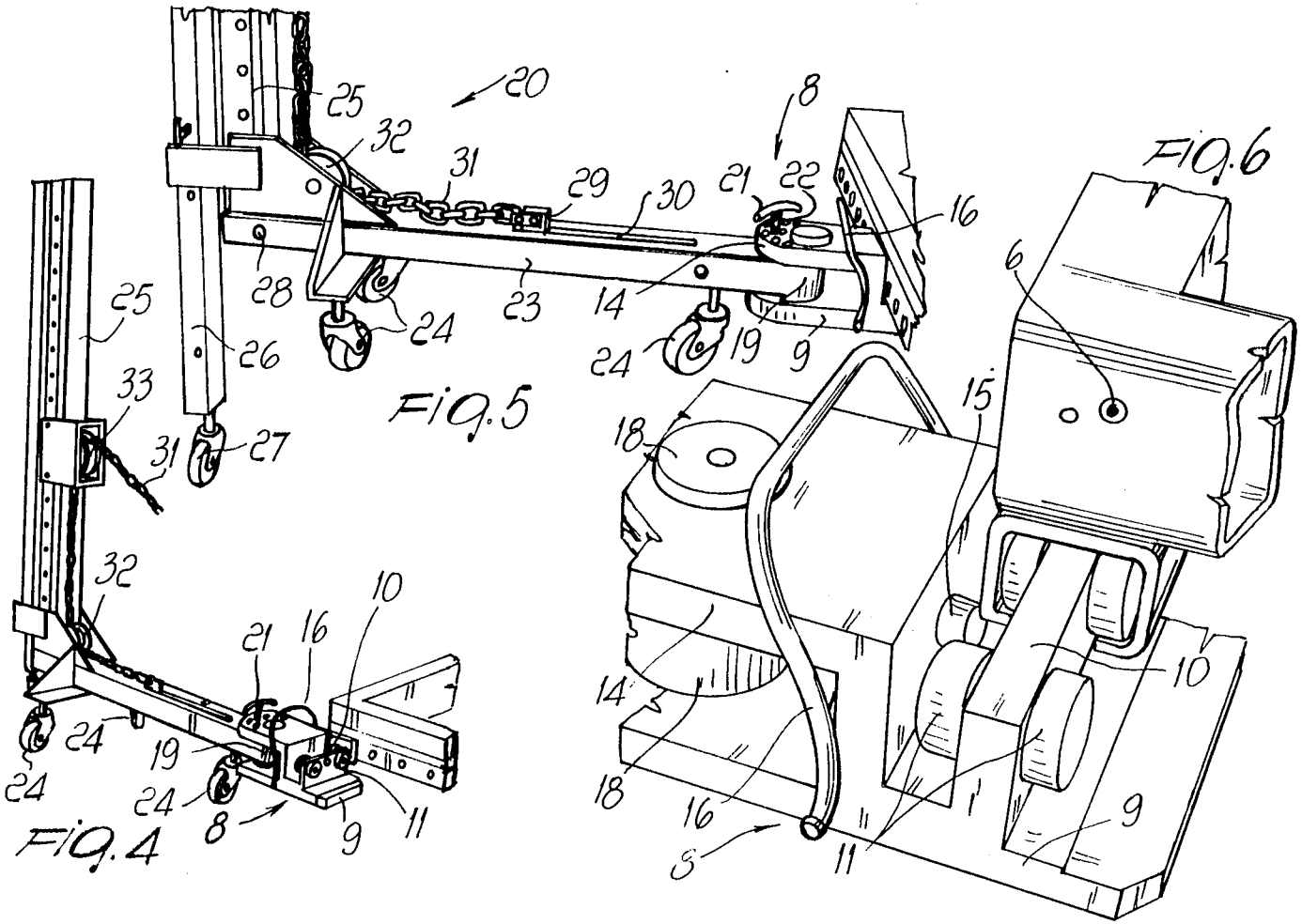
FIG. 4 is a perspective view of a traction support comprised within the apparatus according to the invention and associable with the frame of the preceding figures.
FIG. 5 is an enlarged perspective detail view of the support of FIG. 4.
FIG. 6 is an enlarged perspective detail view of a carriage which is slidable on the frame and to which the support of FIGS. 4 and 5 is articulated.
Figure 10:
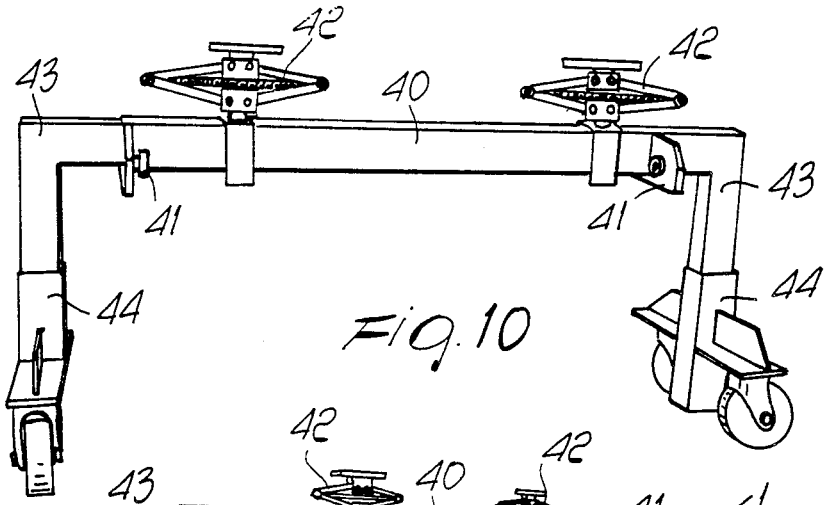
Figure 11:
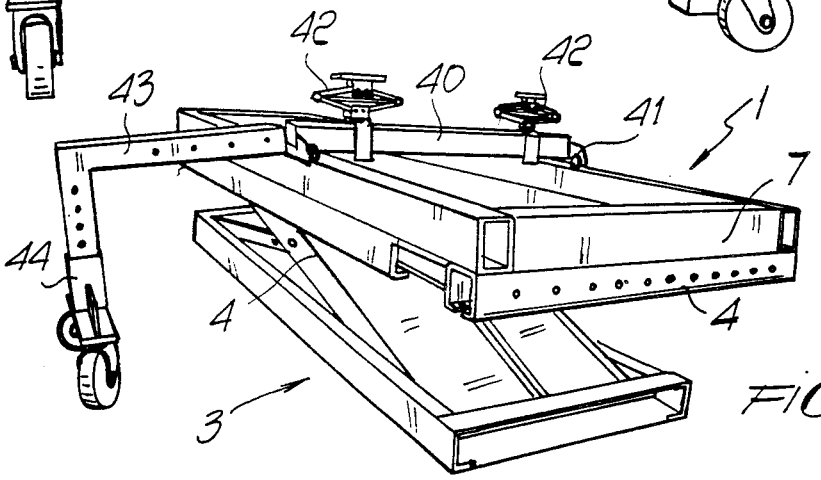
Figure 12:
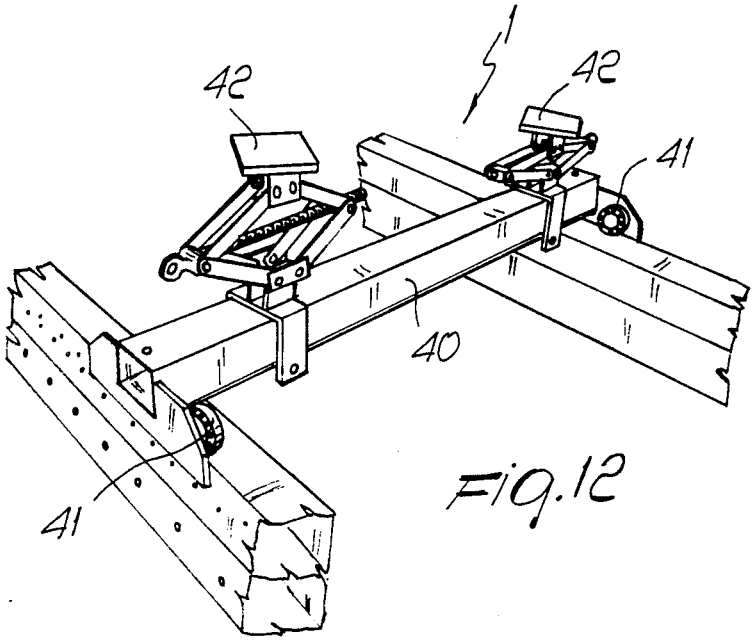

FIG. **6*a*** is a sectional detail view of a device for reinforcing the coupling of the slidable truck to the frame;

FIG. 7 is an enlarged perspective detail view of the support of FIG. 4 in the region of a fixed transmission of the traction element;

FIGS. 8 and 9 are two perspective views of a movable transmission block for the traction element;

FIG. 10 is a front view of a wheeled crosspiece adapted to raise and position a vehicle on the frame of the apparatus according to the invention;

FIG. 11 is a view of the crosspiece of FIG. 10 on the frame;

FIG. 12 is an enlarged perspective detail view of the crosspiece of FIGS. 10 and 11 without the wheeled elements for resting on the ground.

DESCRIPTION OF THE PREFERRED EMBODIMENTS

With reference to the above described figures, the apparatus according to the invention comprises a rectangular frame 1, advantageously made of tubular metal material and arranged horizontally; a vehicle to be repaired can be fixed on said frame by means of appropriate templates.

Said frame 1 is conveniently made of tubes with a rectangular cross section and has, its central portion, a plane 2 on which a raising and lowering mechanism advantageously constituted by a pantograph mechanism 3, is fixed. The mechanism 3 is adapted to raise and lower the frame 1 to the required height from the ground up to at least approximately one and a half meters.

It should be noted that by means of the pantograph lifting mechanism 3 it is possible to use all of the space available around the frame, with the possibility of working more conveniently on the lower parts of vehicles.

Said pantograph mechanism is advantageously actuated by pistons with safety locking devices.

According to the invention, longitudinal guide elements 4 are perimetrically welded to said frame 1 and are constituted, in the illustrated embodiment, by metal tubes having a quadrangular cross section with a longitudinal slot 5 arranged in the lower part.

Said longitudinal elements 4 constitute further elements for stiffening the structure of the frame 1 in which holes 6 are provided for fixing said commonly commercially available templates.

A thermally stable graduated strip 7, adapted to constitute a numeric and positioning reference, is advantageously associated with the perimeter of said frame 1.

As stated in the description of the drawings, FIG. 4 shows a perspective view of a traction support which is connectable to the frame 1. FIGS. 5 and 6 further show enlarged perspective details of such traction support means. According to the invention, a carriage 8 is slidably associable with said longitudinal guiding elements 4 and has a base 9 wherefrom a wing 10 extends substantially vertically; said wing is insertable in said slot 5 and has sliding elements, advantageously comprised of wheels 11, which can be accommodated inside each of said guiding elements 4.

The wing 10 and the wheels 11 are inserted through end openings 12 or lateral openings 13 provided on the elements 4.

An L-shaped block defining a horizontal wall and a vertical wall extends upward from said base 9 of the carriage 8, and the vertical wall is arranged laterally at the outer side of the corresponding guide element 4. The block 14 is provided with traction support fixing means advantageously comprising a stop element 15 slidably accommodated in the vertical wall of the L-shaped block which can be retracted by means of a lever 16 and is adapted to be inserted into one of a series of holes 17 provided on the element 4.

The holes 17 are conveniently arranged at an identical distance from one another, preferably 100 millimeters.

As illustrated in FIG. 6*a*, the coupling of the truck to the frame can be reinforced in order to withstand the flexing stresses to which it is subjected by the structure it supports.

In particular, the traction support fixing means further comprise a metal bracket 102 which can be fixed by means of a screw 101 above the free end of said base 9; the upper end 103 of said bracket is conveniently hook-shaped and connected to a metal bar 104 welded to the frame 1 in a longitudinal internal position.

Tightening the screw 101 rigidly couples the bracket 102 with the bar 104, while slackening said screw 101 allows reciprocal sliding of the parts and therefore allows the carriage 8 to be moved.

An end 19 of a support 20, made of metal tubes welded at right angles, is rotatingly arranged in an interspaced formed between the base 9 and the horizontal wall of the block 18. Such end 19 is articulated on a substantially vertical pivot 18 which traverses said horizontal wall of said block 14; said support can thus be raised and lowered together with the frame 1.

The support 20 is articulated on a horizontal plane, and its position relative to the block 14 can be selected and locked by means of a cylindrical bar 21. The bar 21 can be inserted in holes 22 formed in the block 14 and in corresponding holes of the end 19.

The horizontal arm 23 of said support 20 is advantageously provided with wheels 24 adapted to facilitate its maneuvering on the ground when it is uncoupled from the frame 1. The traction support is furthermore provided with a vertically adjustable rolling upright with a free rolling end. Such rolling upright is in the form of an upright member 26 which is slidably associated with the vertical arm 25 so that it can be locked and is downwardly provided with a wheel 27 adapted to constitute a resting element for said support 20 when it is associated with the frame 1 raised at various heights from the ground.

An actuation piston for the traction means is accommodated longitudinally inside said horizontal arm 23; only the pivoting point 28 of said piston is illustrated in FIG. 5.

A block 29 is rigidly associated with said piston and is slidable in a slot 30 positioned longitudinally on the upper part of said horizontal arm 23; the end of a traction means, constituted by a metal chain 31, is rigidly associated with said block 29.

A first transmission roller 32 for the chain 31 is arranged at the coupling region between the two arms 23 and 25; said chain is also guided by a second roller 33 which revolves on a vertical axis inside a box-like element 34.

Said box-like element 34 is slidably associated with the vertical arm 25, which is provided, along its extension, with a series of lateral holes 35 in which pins are insertable; said pins extend from a handle 36, which is inserted into the box-like element 34 and is adapted to lock the box-like element to the vertical arm.

It should be noted that said arm 25 is longitudinally provided with a graduated strip 37 adapted to act as a positioning reference for the box-like element 34.

A further series of holes 38 is adapted to be engaged by a pin 39, which prevents the box-like element 34 from falling after the handle 36 is disengaged.

The coupling between the box-like element 34 and the arm 25 is performed with such play as to permit disengagement of the pin 39 when required.

The apparatus according to the invention is completed by a pair of vehicle-holder crosspieces 40 which are slidable along said frame 1. The crosspieces 40 are provided with appropriate rotation elements constituted by pairs of bearings 41 which rotate along the longitudinal sides of said frame.

Each crosspiece 40 is provided with vehicle lifting means advantageously constituted by two jacks 42 which are slidable thereon and are adapted to raise and position the vehicle to be repaired onto said templates.

Each crosspiece 40 is substantially constituted by a tubular element with open ends, into which ends of L-shaped elements 43 are insertable; the opposite ends of said L-shaped elements are in turn inserted in wheeled tubular elements 44.

The position of said L-shaped elements with respect to the crosspieces 40 and with respect to the elements 44 is advantageously adjustable and lockable by means of couplings between holes and locking pins as previously described. It is therefore seen that the L-shaped elements 43 and wheeled elements 44 form adjustable-height rolling elements which are connected to the ends of crosspieces 40.

The vehicle is positioned on the frame 1 by resting on the pair of crosspieces 40 which, when coupled to the adjustable-height rolling elements 44, constitute a carriage. The carriage is slidable on the ground, and such carriage can be positioned above the frame 1 when the frame 1 is arranged in a lowered condition.

By lifting the frame 1, the pairs of bearings 41 of the crosspieces 40 are caused to rest on the frame 1, and said crosspieces can thus slide thereon.

By actuating the jacks 42, the vehicle can be raised and positioned on the templates.

With respect to conventional apparata, the apparatus according to the invention has a series of advantages which are stated hereafter.

First of all, the support 20 for the traction means moves in a very simple and rapid manner and can be moved both when the frame is lowered and when it is raised.

In conventional systems the support is in fact moved only by releasing it from the frame.

With the new apparatus it is sufficient to slacken the screw 101, to release the stop element 105 with the lever 16 and to slide the carriage 8 inside the guide element 4.

The possibility of the support 20 to continuously slide on the frame 1, combined with the lack of vertical supporting columns, makes rotation of the support about its own horizontal axis redundant, since it can slide to an angular end of the frame and exploit the rotation about the pivoting point on the block 14 to be arranged in any point of space.

The particular position of the traction piston, combined with the possibility of adjusting the height of the chain's upper transmission point, allow to obtain improved traction, which can even reach points at a lower level with respect to the frame 1, without having to apply other mechanisms as occurs in conventional apparata.

The provision of the graduated strips along the longitudinal elements 4, combined with the provision of the series of holes 17, the provision of the graduated strip 37 on the support 20 combined with the further series of positioning holes 38 of the box-like element 34, and the provision of a graduated strip along the perimeter of the element 14 allow the operator to subject the damaged vehicle to a traction of measured extent.

Finally, the adoption of the wheeled crosspieces 40 does not require the devices currently used to load the vehicle on the frame and fix it to the templates (series of platforms, trucks, stands). In fact, the crosspieces allow the vehicle to be mounted when the templates have already been placed on the frame.

When they are not used to mount the vehicle on the frame, the wheeled crosspieces 40 can be used for other vehicle repair work, such as moving vehicles and assembling or disassembling mechanical parts.

From what has been described above it is therefore evident that the invention achieves the intended aim and objects.

The invention thus conceived is susceptible to numerous modifications and variations, all of which are within the scope of the inventive concept.

All the details may furthermore be replaced with other technically equivalent elements.

In practice, the materials employed, as well as the dimensions, may be any according to the requirements.

What is claimed is:

1. Apparatus for repairing damaged vehicles, comprising;

a frame for supporting, by means of template means being connected to said frame, a vehicle to be repaired, said frame being supportable on the ground and defining a plane of lay being positionable substantially parallel to the ground, said frame being positionably movable in a substantially vertical direction, a raising and lowering mechanism means for raising and lowering said frame in the vertical direction, traction means for putting into straightening traction damaged bodywork of a vehicle to be repaired, said traction means being supported by traction support means, said traction support means being positionably connected with said frame, at least two vehicle-holder crosspiece means being slidable on said frame, vehicle lifting means being connected to said crosspiece means and acting with said slidable crosspiece means for lifting and positioning a vehicle to be repaired onto said template means, wherein said crosspiece means comprise adjustable-height rolling element means being connected at ends of said crosspiece means, said adjustable-height rolling element means being vertically adjustable and having free rolling ends for rolling contact with the ground for giving support to said crosspiece means in any vertical position of said frame.

2. Apparatus according to claim 1, wherein said traction support means comprise vertically adjustable rolling upright means being connected to said traction support means and having free rolling extremities for rolling contact with the ground for giving support to said traction support means in any vertical position of said frame.

3. Apparatus according to claim 2, further comprising;

traction support fixing means for at least temporarily rigidly connecting said traction support means to said frame, wherein said frame comprises guiding element means for slidably guiding said traction support means on said frame, said guiding element means comprising tube element means defining a tube longitudinal extent and a tube interior thereof, a slot means being provided in said tube means, said slot means having a slot longitudinal extent being defined along at least a portion of said tube longitudinal extent of said tube element means, said traction support means comprising a sliding carriage means having a protruding wing means, said protruding wing means being provided with sliding element means, said protruding wing means being slidably accommodated in said slot means of said tube means and said sliding element means being slidably positionably supported in said tube interior of said tube means.

4. Apparatus according to claim 1, wherein said raising and lowering mechanism means comprise a pantograph mechanism adapted to raise and lower said frame to a required height up to at least one and a half meters.

5. Apparatus according to claim 1, wherein each one of said crosspiece means is comprised of tubular element means having open ends, said adjustable-height rolling element means comprising a substantially L-shaped element means having a substantially horizontal leg being adjustably insertably connected in said open ends of said each crosspiece and a substantially vertical leg being downwardly provided with rolling element means for supporting contact with the ground.

6. Apparatus according to claim 1, wherein each one of said crosspiece means is provided with rotating bearing means for rotatingly supporting said each crosspiece on said frame, said vehicle lifting means comprising adjustable jack means being slidable connected on said crosspiece means.

7. Apparatus for repairing damaged vehicles, comprising;

a frame for supporting, by means of template means being connected to said frame, a vehicle to be repaired, said frame being supportable on the ground and defining a plane of lay being positionable substantially parallel to the ground, said frame being positionably movable in a substantially vertical direction, a raising and lowering mechanism means for raising and lowering said frame in the vertical direction, traction means for putting into straightening traction damaged bodywork of a vehicle to be repaired, said traction means being supported by traction support means, said traction support means being positionably connected with said frame, at least two vehicle-holder crosspiece means being slidable on said frame, vehicle lifting means being connected to said crosspiece means and acting with said slidable crosspiece means for lifting and positioning a vehicle to be repaired onto said template means, wherein said traction support means comprise vertically adjustable rolling upright means being connected to said traction support means and having free rolling extremities for rolling contact with the ground for giving support to said traction support means in any vertical postion of said frame.

8. Apparatus according to claim 7, wherein said traction support means for supporting said traction means further comprise a substantially L-shaped support means defining a horizontally arrangeable first arm and a vertically arrangeable second arm, said first horizontal arm being positionably connected with said frame, said vertically adjustable rolling upright means comprising a vertical upright being adjustably connected to said second vertical arm, said vertical upright having a free lower end being provided with supporting rolling wheel element means.

9. Apparatus for repairing damaged vehicles, comprising;

a frame for supporting, by means of template means being connected to said frame, a vehicle to be repaired, said frame being supportable on the ground and defining a plane of lay being positionable substantially parallel to the ground, traction means for putting into straightening traction damaged bodywork of a vehicle to be repaired, said traction means being supported by traction support means, said traction support means being positionably connected with said frame, traction support fixing means for at least temporarily rigidly connecting said traction support means to said frame, wherein said frame comprises guiding element means for slidably guiding said traction support means on said frame, said guiding element means comprising tube element means defining a tube longitudinal extent and a tube interior thereof, a slot means being provided in said tube means, said slot means having a slot longitudinal extent being defined along at least a portion of said tube longitudinal extent of said tube element means, said traction support means comprising a sliding carriage means having a protruding wing means, said protruding wing means being provided with sliding element means, said protruding wing means being slidably accommodated in said slot means of said tube means and said sliding element means being slidably positionably supported in said tube interior of said tube means.

10. Apparatus according to claim 9, wherein said frame is substantially rectangular, said guiding element means being perimetrically welded to a lower side of said frame and having a substantially quadrangular cross-section and a lower wall in which said slot means is provided, said sliding carriage means having a substantially horizontal base from which said wing means protrudes vertically upwards therefrom, said sliding element means comprising wheel means rotatingly connected to said wing means, said tube means of said guiding element means having end openings and lateral openings for inserting said wing means with said wheel means therein, said traction support fixing means being connected to said sliding carriage means.

11. Apparatus according to claim 10, wherein said sliding carriage means further comprises an L-shaped block extending upwardly from said base and having a vertical wall and a horizontal wall, said vertical wall of said L-shaped block being arrangeable laterally to an outer side of said guiding element means when said sliding carriage means is connected to said guiding element means, said traction support fixing means comprising a stop element slidably protruding from said vertical wall of said L-shaped block, said stop element being slidably actuated by lever means connected to said carriage means, said outer side of said guiding element means being provided with a plurality of hole means for receivably accommodating said stop element, said traction support fixing means further comprising an upwardly hooked-shaped metal bracket means being releasably fixed to said base of said carriage means by screw means, said frame being provided with a shaped metal bar means fixed at an inner side thereof, said hooked-shaped metal bracket means fixably mating with said shaped metal bar means when said screw means are tightened.

12. Apparatus according to claim 10, wherein a thermally stable graduated strip means is perimetrically provided on said frame, said strip means constituting a numeric positioning reference.

13. Apparatus according to claim 9, wherein said frame is laterally provided with template hole means, said template means being connected to said frame at said template hole means by means of template fixing means.

14. Apparatus according to claim 9, wherein said traction support means for supporting said traction means further comprise a substantially L-shaped support means defining a horizontally arrangeable first arm and a vertically arrangeable second arm, said first horizontal arm being rotatably connected to said carriage means by means of a pivot means, said first horizontal arm being fixable in a selected angular position with respect to said carriage means by position bar means insertable into positioning hole means provided in said first horizontal arm and said carriage means, said first horizontal arm being downwardly provided with sliding wheel support means, said vertical second arm having a slidable box means being slidably and positionable connected thereto by means of pin means and pin hole means being provided in said box means and said vertical second arm means.

15. Apparatus according to claim 14, wherein said box means is further provided with handle means, said handle means being provided with handle pin means for insertion into positionably mating handle hole means provided in said box means and said second vertical arm, said second vertical arm being provided with a graduated strip means acting as a positioning reference for said box means.

16. Apparatus according to claim 14, wherein said traction means comprise a first roller means rotatingly connected to said L-shaped support means at a connection region between said horizontal first arm and said vertical second arm, a second roller means rotatingly connected to said slidable box means, a fluid actuated piston longitudinally arranged in said horizontal first arm and having a movable end and a fixed end being fixed to a pivot point of said horizontal first arm, a chain means having a first end connected to said movable end of said piston by means of a block mechanism means connected to said movable end of said piston and protruding from said horizontal first arm through a slot means provided in said horizontal first arm, said chain means engaging with said first and second roller means and having a second free end being connectable to damaged bodywork regions of a vehicle to be repaired.

* * * * *